US005264812A

United States Patent [19]

Tomono et al.

[11] Patent Number: 5,264,812

[45] Date of Patent: Nov. 23, 1993

[54] SMALL, ECONOMICAL AND STABLE POLARIZED ELECTROMAGNETIC RELAY HAVING TWO GROUPS OF ELECTROMAGNETIC RELAY PORTIONS

[75] Inventors: Noboru Tomono, Nagano; Shigemitsu Aoki; Yoshinori Sakurai, both of Saku, all of Japan

[73] Assignee: Takamisawa Electric Co., Ltd., Tokyo, Japan

[21] Appl. No.: 38

[22] Filed: Jan. 4, 1993

[30] Foreign Application Priority Data

May 19, 1992 [JP] Japan ..... 4-168152
May 26, 1992 [JP] Japan ..... 4-46273[U]

[51] Int. Cl.[5] ..... H01H 51/22
[52] U.S. Cl. ..... 335/78; 335/202
[58] Field of Search ..... 335/78-86, 335/124, 128, 131, 132, 133, 202

[56] References Cited

U.S. PATENT DOCUMENTS 4,617,541 10/1986 Chuang ..... 335/133
4,959,627 9/1990 Iizumi et al. ..... 335/106

FOREIGN PATENT DOCUMENTS 1-167930 7/1989 Japan .
1-155245 10/1989 Japan .
4-272630 9/1992 Japan .

*Primary Examiner*—Lincoln Donovan
*Attorney, Agent, or Firm*—Nikaido, Marmelstein, Murray & Oram

[57] ABSTRACT

A polarized electromagnetic relay has two electromagnetic relay portions each constituted by a first yoke, second yoke, coil, movable core, card, and the like. The first yoke and the second yoke are used to flow a magnetic flux caused by a permanent magnet in the movable core in the same direction as a magnetic flux caused by the magnetization of the coil, and thus electrical power flowing in the magnetized coil can be small, or an area occupied by the coil can be small. Therefore, a small size and economical polarized electromagnetic relay having two groups of electromagnetic relays can be provided, and a stable operation regardless the states of magnetization or non-magnetization of one or both coils of the two electromagnetic relay portions can be realized.

18 Claims, 18 Drawing Sheets

SMALL, ECONOMICAL AND STABLE POLARIZED ELECTROMAGNETIC RELAY HAVING TWO GROUPS OF ELECTROMAGNETIC RELAY PORTIONS

BACKGROUND OF THE INVENTION

1. Field of the Invention

The present invention relates to an electromagnetic relay, more particularly, to a polarized electromagnetic relay having two groups of electromagnetic relay portions.

2. Description of the Related Art

In recent years, in accordance with advances in deluxe automobiles, various kinds of electrical equipment for these automobiles have been developed. Note, a basic mechanism of automotive electrical equipment is provided to control the direction of rotation of a motor or the direction of movement of a solenoid, and an electromagnetic relay is used to control the directions thereof. Concretely, in an automobile, a motor is used to control the operation of an automatic window (power window), retractable head light, sunshine roof, power seat, electrical folding mirror, and the like, and a solenoid is used to control the operation of an automatic door lock, and various actuators.

Note, in recent years, it is required for an electromagnetic relay to be decreased in size and cost thereof, and thus, there has been provided an electromagnetic relay having two groups of electromagnetic relay portions, i.e., two coil elements, two movable cores, two movable contact springs, and the like. Further, a polarized electromagnetic relay having two groups of electromagnetic relay portions and one permanent magnet has been proposed by the same applicant of this application under Japanese Unexamined Patent Publication (Kokai) No. 4-272630.

SUMMARY OF THE INVENTION

An object of the present invention is to provide a polarized electromagnetic relay having two groups of electromagnetic relay portions and being small in size and low in cost. Further, another object of the present invention is to provide a polarized electromagnetic relay having two groups of electromagnetic relay portions and having a stable operation regardless the states of magnetization or nonmagnetization of one or both coils of the two electromagnetic relay portions. In addition, still another object of the present invention is to provide a polarized electromagnetic relay having two groups of electromagnetic relay portions and having a stable operation and durability by improving card construction of the two electromagnetic relay portions.

According to the present invention, there is provided a polarized electromagneticrelay comprising a base block, a first yoke mounted on the base block, a second yoke mounted on the base block to form magnetic circuits with the first yoke, a permanent magnet provided between the first yoke and the second yoke, two coil elements including two coils, two movable cores being independently operated by the magnetization of each of the coils, two cards each fixed to the top portion of each of the two movable cores, two movable contact springs having movable contacts operated by working together with the cards, and stationary contact springs provided opposite each other on the base block, and each of the movable contact springs being positioned between the stationary contact springs, wherein the first yoke and the second yoke are used to flow a magnetic flux caused by the permanent magnet in the movable core in the same direction as a magnetic flux caused by the magnetization of the coil.

The second yoke may be in contact with the permanent magnet through a pole piece. The second yoke and the pole piece may be uniformly formed. The top portion of the second yoke may be formed as an E-shape configuration to be bent to constitute the pole piece, or the top portion of the second yoke may be formed as a T-shape configuration to be bent to constitute the pole piece.

According to the present invention, there is also provided a polarized electromagnetic relay comprising, a base block, first and second yoke elements having the same shapes and mounted on the base block, first and second pole piece elements to form magnetic circuits with the first and second yoke elements, a permanent magnet provided between the first pole piece element and the second pole piece element, two coil elements including two coils, two movable cores being independently operated by the magnetization of each of the coils, two cards each fixed to the top portion of each of the two movable cores, two movable contact springs having movable contacts being operated by working together with the cards, and stationary contact springs provided opposite each other on the base block, and each of the movable contact springs being positioned between the stationary contact springs, wherein the first and second yoke elements and the first and second pole piece elements are used to flow a magnetic flux caused by the permanent magnet in the movable core in the same direction as a magnetic flux caused by the magnetization of the coil.

The card may include a hole at one end of the card, the coil element may include a protrusion portion at one flange of the coil element, and the protrusion portion of the coil element may be inserted into the hole of the card. Further, the card may include a protrusion portion at one end of the card, the coil element may include a hole at one flange of the coil element, and the protrusion portion of the card may be inserted into the hole of the coil element.

One end of the card may be supported at a supporting point by the coil element, and the movable core may be fixed at a fixed point by the card. The card may be rounded about the supporting point.

The card may comprise a U-shape groove at approximately the center of the card, and the movable contact spring may be fitted into the groove of the card. The polarized electromagnetic relay may be applied to control the direction of rotation of a motor or the direction of movement of a solenoid.

BRIEF DESCRIPTION OF THE DRAWINGS

The present invention will be more clearly understood from the description of the preferred embodiments as set forth below with reference to the accompanying drawings, wherein.

DESCRIPTION OF THE PREFERRED EMBODIMENTS

For a better understanding of the preferred embodiments, the problems of the related art will be explained, with reference to FIGS. 1 to 7.

Figure 1:
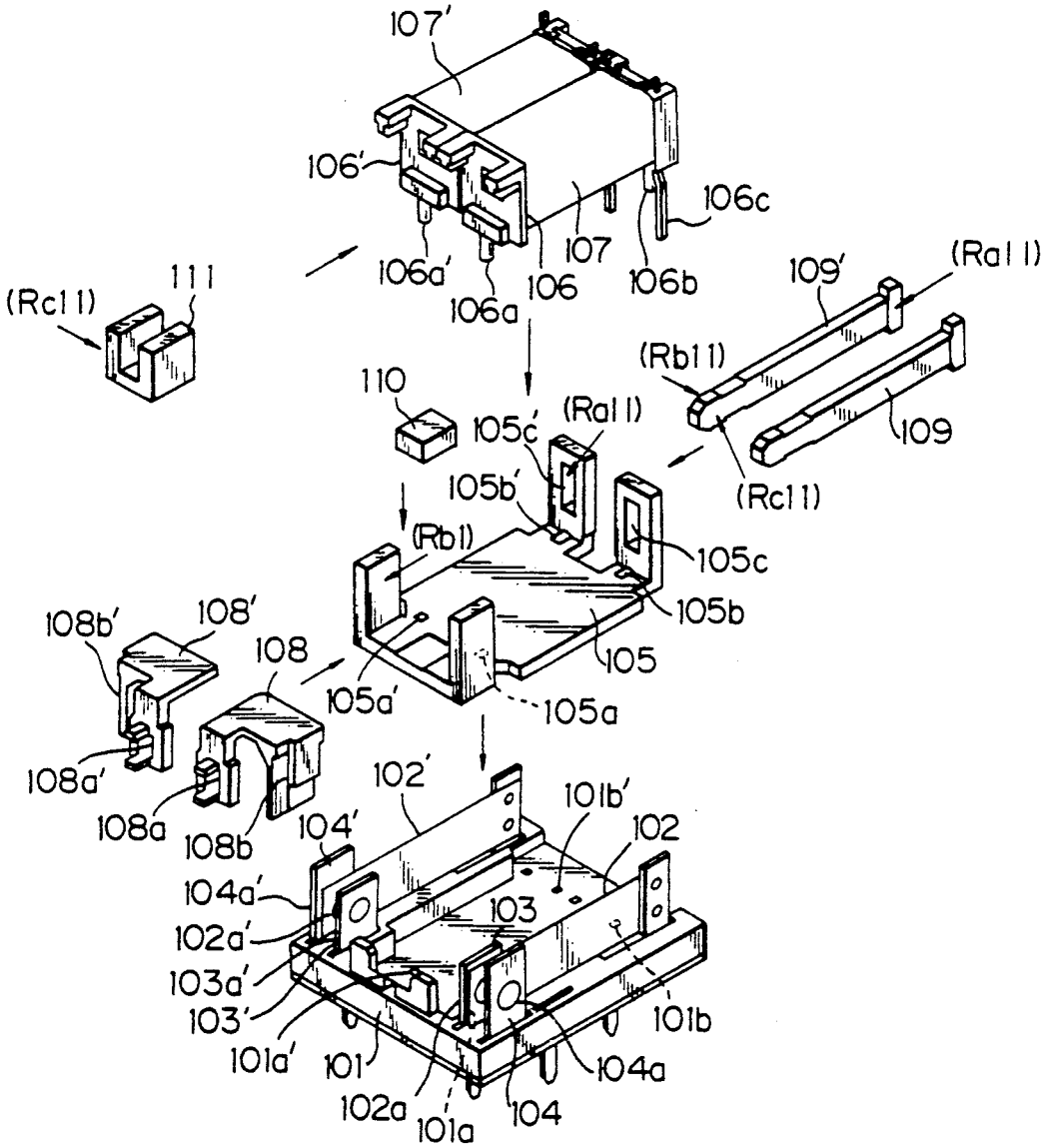
FIG. 1 is an exploded perspective diagram showing an example of a polarized electromagnetic relay according to the related art.

FIG. 1 shows an example of a polarized electromagnetic relay according to the related art. In FIG. 1, reference numeral 101 denotes a base block, 102, 102' denote movable contact springs, 103, 103' denote break-stationary contact springs, 104, 104' denote make-stationary contact springs, and 105 denotes a yoke. Further, in FIG. 1, reference numerals 106, 106' denote coil elements, 107, 107' denote coils, 108, 108' denote cards, 109, 109' denote movable cores, 110 denotes a permanent magnet, and 111 denotes a pole piece.

As shown in FIG. 1, the related art electromagnetic relay comprises two groups of electromagnetic relay portions. Namely, one electromagnetic relay portion comprises a movable contact spring 102, break-stationary contact spring 103, make-stationary contact spring 104, coil element 106, coil 107, card 108, and movable core 109; and another electromagnetic relay portion comprises a movable contact spring 102', break-stationary contact spring 103', make-stationary contact spring 104', coil element 106', coil 107', card 108', and movable core 109'.

Note, a base block 101, yoke 105, permanent magnet 110, and pole piece 111 are commonly provided for both electromagnetic relay portions, a part of a magnetic circuit is commonly used for two electromagnetic relay portions, and thus the size of the polarized electromagnetic relay can be small and the total cost of the polarized electromagnetic relay can be decreased. Especially, the cost of the permanent magnet 110 is quite expensive, and thus, it is effective to decrease the cost of the polarized electromagnetic relay by commonly providing one permanent magnet 110 for two electromagnetic relay portions.

Figure 2:
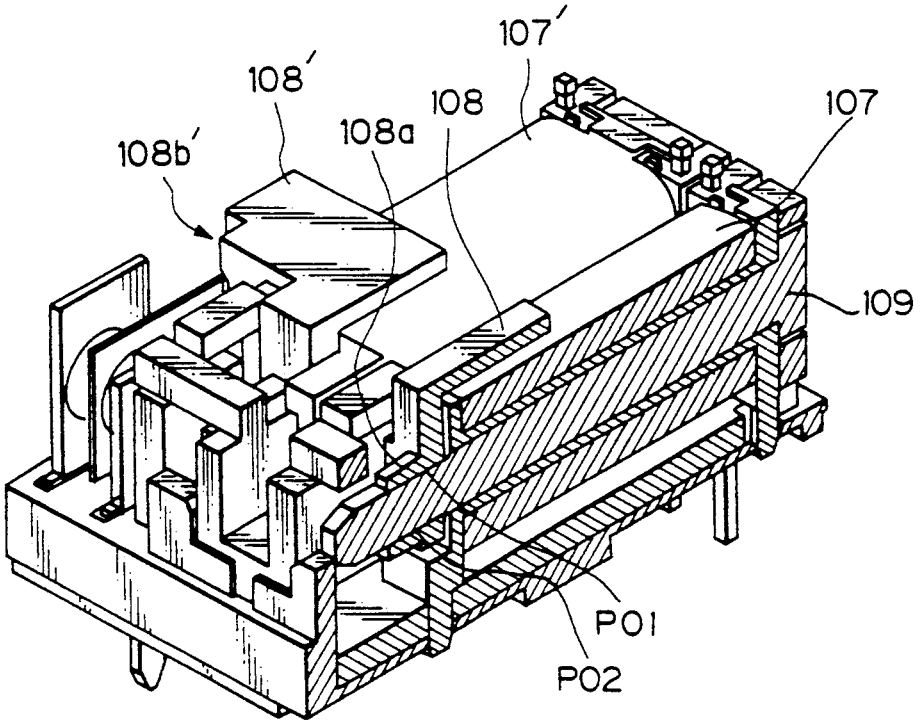
FIG. 2 is a perspective diagram and partly in section showing the polarized electromagnetic relay shown in FIG. 1.

FIG. 2 shows the polarized electromagnetic relay shown in FIG. 1. In FIG. 2, references P01 and P02 denote fixed points between the card 108 and the movable core 109.

Figure 4A:
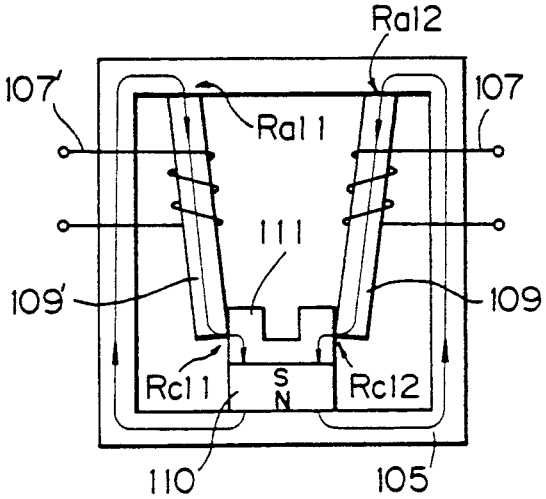
FIGS. 4A, 4B, 4C and 4D are diagrams for explaining operational states of coil elements and movable cores of the polarized electromagnetic relay shown in FIG. 1.
Figure 4B:
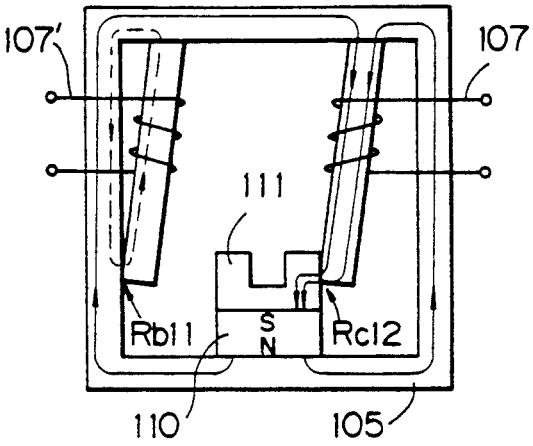

As shown in FIG. 2, the card 108 is contacted with the movable core 109 at the fixed points (supporting positions) P01 and P02 at an end **108*a* of the card, and the movable contact spring 102 is contacted with the card 108 at a groove portion 108*b* (contact point, or force applying point P0) of the card 102** (with reference to FIGS. 1, 4A and 4B).

Next, operation of the polarized electromagnetic relay of the related art will be explained.

Figure 3A:
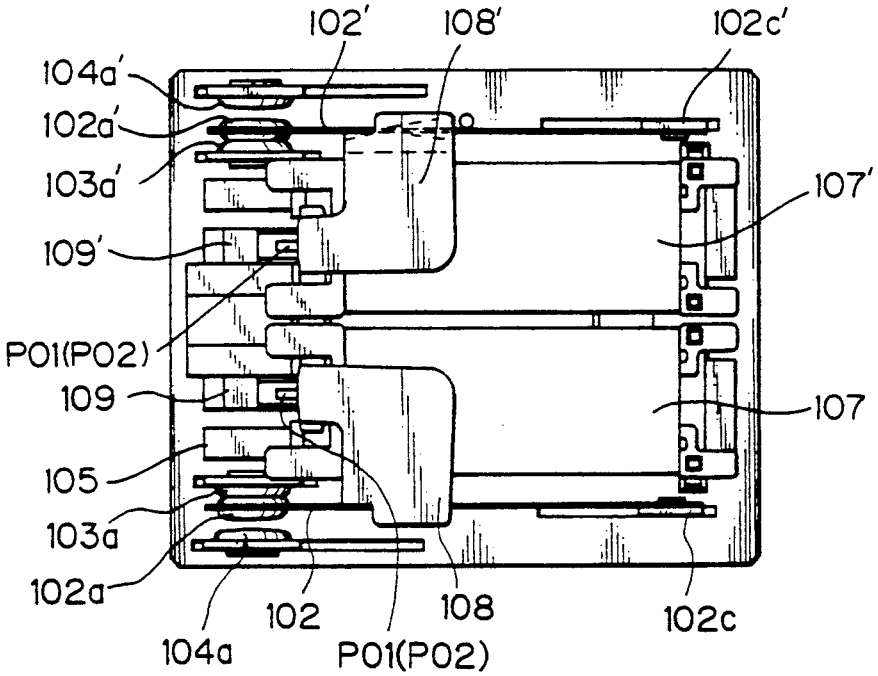
FIGS. 3A and 3B are diagrams for explaining operational states of the polarized electromagnetic relay shown in FIG. 1.
Figure 3B:
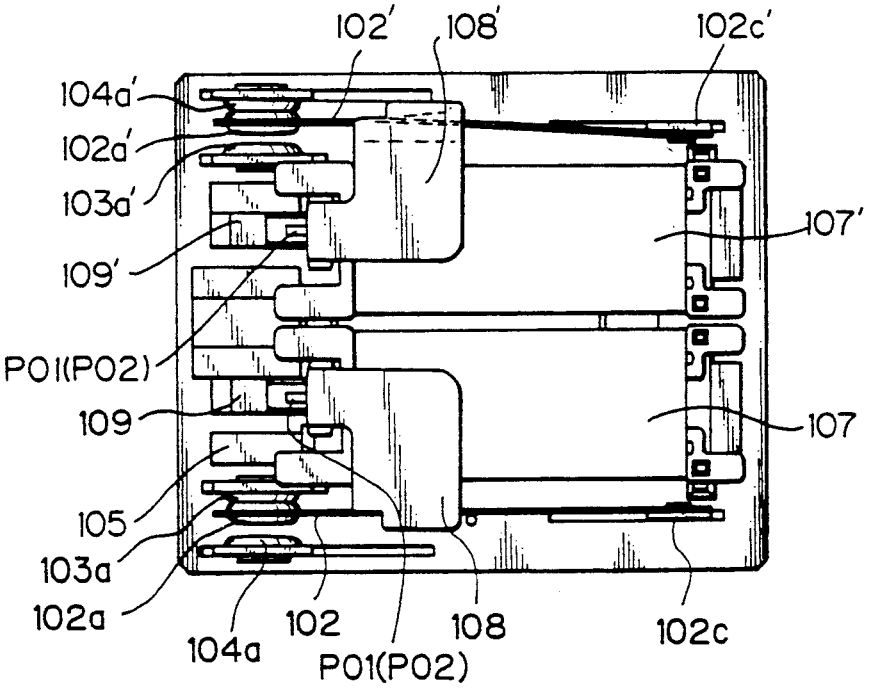
Figure 4C:
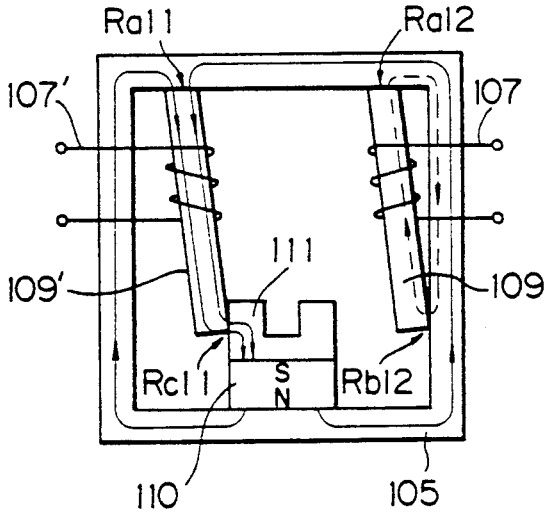
Figure 4D:
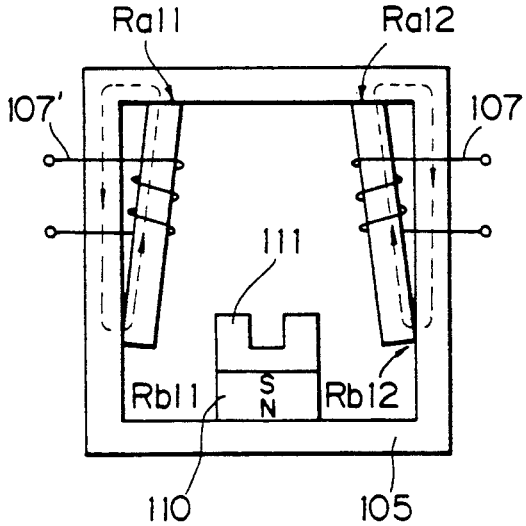

FIGS. 3A and 3B show operational states of the polarized electromagnetic relay shown in FIG. 1. Further, FIGS. 4A, 4B, 4C and 4D also show operational states of coil elements and movable cores of the polarized electromagnetic relay shown in FIG. 1. FIGS. 3A and 4A show the state when both coils 107, 107' are not magnetized, FIGS. 3B and 4B show the state when one oil 107' is magnetized while the other coil 107 is not magnetized, FIG. 4C shows the state when one coil 107 is magnetized while the other coil 107' is not magnetized, and FIG. 4D shows the state when both coils 107, 107' are magnetized. In FIGS. 4A to 4D, references Rb11 and Rb12 denote magnetic reluctances between one end of the movable cores 109', 109 and the yoke 105, Rc11 and Rc12 denote magnetic reluctances between one end of the movable cores 109', 109 and the pole piece 111, and Ra11 and Ra12 denote magnetic reluctances between another ends of the movable cores 109', 109 and the yoke 105.

First, as shown in FIGS. 3A and 4A, when both coils 107, 107' are not magnetized, the movable cores 109, 109' are attracted to the pole piece 111, movable contacts **102*a*, 102*a'* of the movable contact springs 102, 102' are made to contact the break-stationary contacts 103*a*, 103*a'* by the cards 108, 108', and thereby each electromagnetic relay portion is maintained in a break state. In this state, a magnetic circuit caused by the permanent magnet 110, which is illustrated by a solid line, is created, and a magnet flux caused by the permanent magnet 110 is flows through the movable cores 109, 109'**.

Next, as shown in FIGS. 3B and 4B, when the coil 107' is magnetized and the coil 107 is not magnetized, a magnetic flux between the movable core 109' and the pole piece 111 caused by the permanent magnet 110 is negated by the magnetic flux flowing through the coil 107', that is, the top portion (one end) of the movable core 109' is changed to the same polarity as that of the pole piece 111 and is repelled, so that the movable core 109′ is attracted to the yoke 105. One end of the movable core 109′ is turned by the magnetization of the coil 107′, pivoting on the other end thereof as a supporting point, and the movable core 109′ is attracted to the yoke 105. Further, the movable core 109′ works together with the card 108′, the movable contact 102a′ is made to contact the make-stationary contact 104a′ by the movable contact spring 102′, and thereby one electromagnetic relay portion including the movable contact spring 102′ is changed to a make state while the other electromagnetic relay portion including the movable contact spring 102 is maintained in a break state. Further, when the coil 107′ is changed to be not magnetized, the state shown in FIGS. 3B and 4B returns to the state of FIGS. 3A and 4A.

Note, as shown in FIG. 4B, after attracting the movable core 109′ to the yoke 105, the magnetic flux (which is shown by a solid line in FIG. 4B) caused by the permanent magnet 110 and the magnetic flux (which is shown by a dot line in FIG. 4B) caused by the magnetized coil 107′ flow in the movable core 109′ in opposite directions, and thus the magnetic flux of the magnetized coil 107′ must be large. Namely, electrical power flowing in the magnetized coil 107′ becomes large, or an area occupied by the coil 107′ becomes large.

Next, as shown in FIG. 4C, when the coil 107 is magnetized and the coil 107′ is not magnetized, a magnetic flux between the movable core 109 and the pole piece 111 caused by the permanent magnet 110 is negated by the magnetic flux flowing through the coil 107, and the movable core 109 is attracted to the yoke 105, so that an electromagnetic relay portion including the movable contact spring 102 is changed to a make state, and the electromagnetic relay portion including the movable contact spring 102′ is maintained in a break state. Further, when the coil 107 is changed to be not magnetized, the state shown in FIG. 4C is returned to the state of FIGS. 3A and 4A.

Note, this state shown in FIG. 4C is the opposite state of that shown in FIGS. 3B and 4B. Namely, as shown in FIG. 4C, after attracting the movable core 109 to the yoke 105, the magnetic flux (which is shown by a solid line in FIG. 4C) caused by the permanent magnet 110 and the magnetic flux (which is shown by a dot line in FIG. 4C) caused by the magnetized coil 107 flow in the movable core 109 in opposite directions, and thus the magnetic flux of the magnetized coil 107 must be large. Namely, electrical power flowing in the magnetized coil 107 becomes large, or an area occupied by the coil 107 becomes large.

Further, as shown in FIG. 4D, when both coils 107, 107′ are magnetized, a magnetic flux between the movable core 109′ and the pole piece 111 caused by the permanent magnet 110 is negated by the magnetic flux flowing through the coil 107′, and further a magnetic flux between the movable core 109 and the pole piece 111 caused by the permanent magnet 110 is negated by the magnetic flux flowing through the coil 107. Therefore, the movable core 109′ is attracted to the yoke 105, and the movable core 109 is also attracted to the yoke 105, so that both electromagnetic relay portions are changed to make states. Further, when the coils 107 and 107′ are changed to be not magnetized, the state shown in FIG. 4D is returned to the state of FIGS. 3A and 4A.

Figure 5:
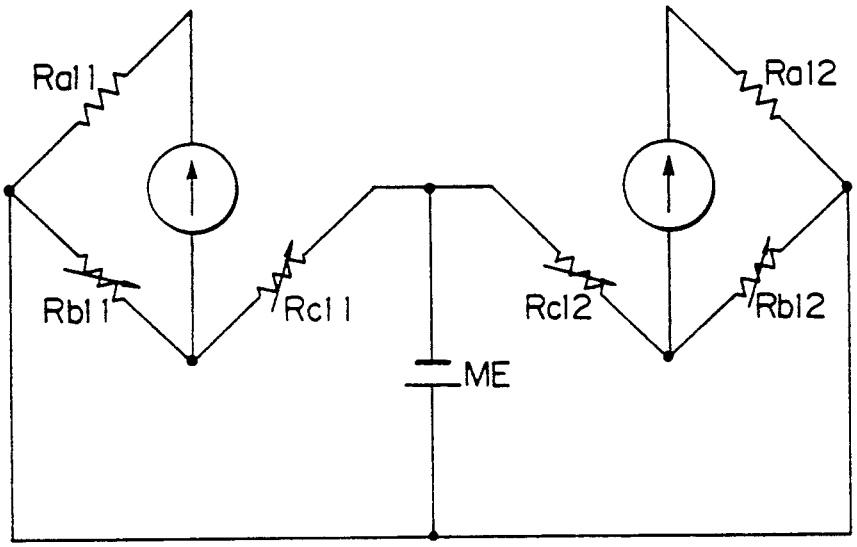
FIG. 5 is a diagram showing an equivalent magnetic circuit of the polarized electromagnetic relay shown in FIG. 1.

FIG. 5 shows equivalent magnetic circuit of the polarized electromagnetic relay shown in FIG. 1.

As shown in FIGS. 4A to 4D and FIG. 5, the magnetic flux of the permanent magnet 110 flowing through the movable core 109 in one electromagnet relay portion is varied in accordance with the change of states of the other electromagnetic relay portion. Namely, for example, the magnetic flux flowing through the movable core 109 in the state shown in FIG. 4B, where only coil 107′ is magnetized, is different from that of the states shown in FIGS. 4A and 4D, as the magnetic flux of the permanent magnet 110 previously flowing through one movable core 109′ must flow through the other movable core 109. Similarly, the magnetic flux flowing through the movable core 109′ in the state shown in FIG. 4C, where only coil 107 is magnetized, is different from that of the state shown in FIG. 4A and 4D, as the magnetic flux of the permanent magnet 110 previously flowing through the movable core 109 must flow through the movable core 109′.

In the above polarized electromagnetic relay of the related art, a magnetic flux of the permanent magnet 110 flowing to the coil element 106 (one electromagnetic portion) is varied in accordance with the change of the magnetic reluctance of the magnetic circuit of the coil element 106′ (another electromagnetic portion). Namely, a magnetic flux of the permanent magnet 110 flowing to each of the electromagnetic portions is different between two states when magnetizing one coil 107 while not magnetizing another coil 107′, and when magnetizing both coils 107 and 107′. Namely, the following relationship is satisfied.

R11-OFF<R11-ON: where, R11-OFF and R11-ON denote magnetic reluctances in the states of not magnetizing and magnetizing the coils, or the cases of operating and stopping the electromagnetic relay portions.

In the polarized electromagnetic relay of the related art, there is problem that operating voltages of the coil elements 106 or 106′ fluctuate in the states when magnetizing one coil 107 (107′) while not magnetizing another coil 107′ (107), and when magnetizing both coils 107 and 107′.

FIGS. 6A, 6B, 6C and 6D shows operational states of a motor by using a electromagnetic relay. In FIGS. 6A to 6D, reference MM denotes a motor, Ma and Mb denote terminals of the motor MM, and S1 and S2 denote switches corresponding to two electromagnetic relay portions of the polarized electromagnetic relay. Note, the state when both coils 107, 107′ are not magnetized shown in FIGS. 3A and 4A corresponds to the case shown in FIG. 6A, and the state when only one coil 107′ is magnetized shown in FIGS. 3B and 4B corresponds to the case shown in FIG. 6B. Further, the state when only one coil 107 is magnetized shown in FIG. 4C corresponds to the case shown in FIG. 6C, and the state when both coils 107, 107′ are magnetized shown in FIG. 4D corresponds to the case shown in FIG. 6D.

Figure 6A:
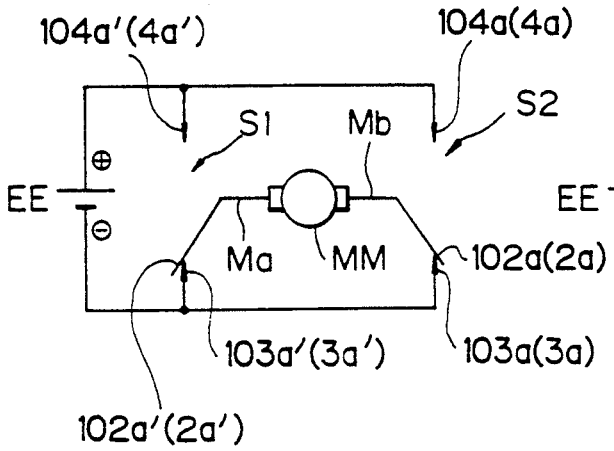
FIGS. 6A, 6B, 6C and 6D are diagrams for explaining operational states of a motor by using a electromagnetic relay.

First, as shown in FIG. 6A, when both coils 107′, 107 are not magnetized, the movable contacts 102a′ and 102a are in contact with break-stationary contacts 103a′ and 103a in both switches S1 and S2, and both terminals Ma and Mb of the motor MM are in contact with a negative pole of a battery EE, so that the motor MM is stopped.

Figure 6B:
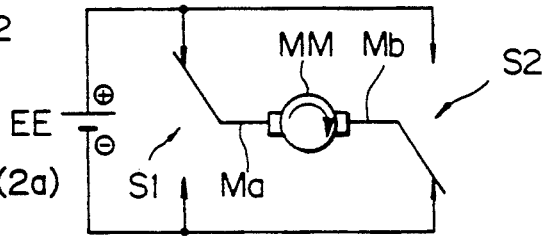
Figure 6C:
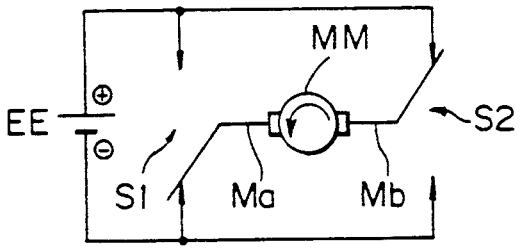

Next, as shown in FIG. 6B, when the coil 107 is magnetized and the coil 107′ is not magnetized, the movable contact 102a′ is in contact with a make-stationary contact 104a′ in the switch S1 and the movable contact 102a is in contact with the break-stationary contact 103a in the switch S2, and the terminal Ma of the motor MM is in contact with a positive pole of the battery EE and the terminal Mb thereof is in contact with the negative pole of the battery EE, so that the motor MM is rotated, e.g., clockwise. Conversely, as shown in FIG. 6C, when the coil 107' is magnetized and the coil 107 is not magnetized, the movable contact 102*a* is in contact with a make-stationary contact 104*a* in the switch S1 and the movable contact 102*a'* is in contact with the break-stationary contact 103*a'* in the switch S2, and the terminal Ma of the motor MM is in contact with the negative pole of the battery EE and the terminal Mb thereof is in contact with the positive pole of the battery EE, so that the motor MM is rotated, e.g., counterclockwise.

Figure 6D:
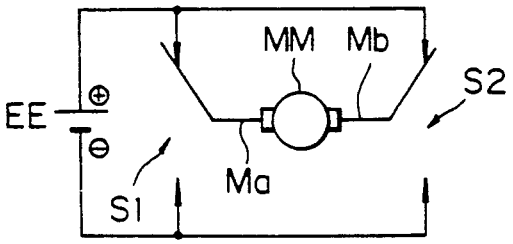

Further, as shown in FIG. 6D, when both coils 107', 107 are magnetized, the movable contacts 102*a'* and 102*a* are in contact with make-stationary contacts 104*a'* and 104*a* in both switches S1 and S2, and both terminals Ma and Mb of the motor MM are in contact with the positive pole of the battery EE, so that the motor MM is stopped.

Figure 7:
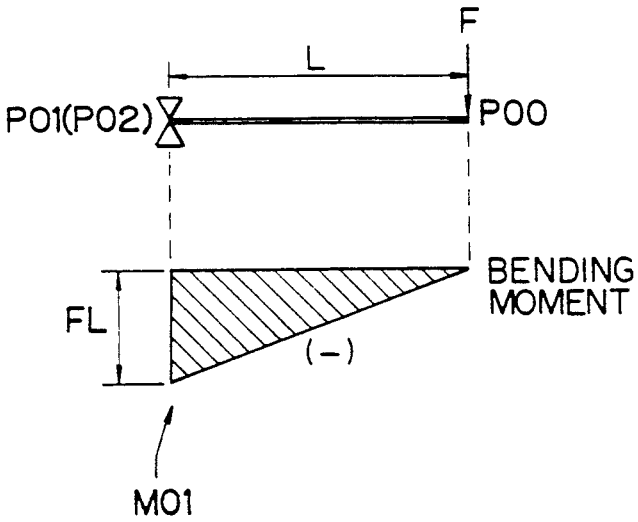
FIG. 7 is a diagram for explaining moments applied to a movable contact spring of the polarized electromagnetic relay shown in FIG. 1.

FIG. 7 shows moments applied to a movable contact spring of the polarized electromagnetic relay shown in FIG. 1. In FIG. 7, reference P01 (P02) denotes a fixed point between the card 108' (108) and the movable core 109' (109), and P00 denotes a force applying point of the card 108' (108). When applying a force F caused by the movable contact spring 102' to the card 108' having L length between the points P01 and P00 at the point P00 perpendicular to the line P01–P00 of the card 108', a bending moment M01 at the point P01 is determined as M01=FL, and a bending moment M00 at the point P00 is determined as M00=0.

Note, as shown in FIG. 7, in a card used for the above electromagnetic relay of the related art, a movable contact spring 102' (102) is moved by a card 108' (108) to which a top portion of a movable core 109' (109) is inserted and jointed at one position (fixed points P01, P02), the fixed position P01 (P02) of the card 108' and the movable core 109' is different from the position P00 to at which is applied the force F of the movable contact spring 102', and thereby a bending moment M01 is caused at the fixed position P01 (P02) between the card 108' and the movable core 109'. Therefore, the joint portion (P01, P02) between the card 108' and the movable core 109' may be weakened, and the gauge of the movable contact spring 102' working together with the card 108' may be changed, so that a defect that changes the operating voltatge may be caused. Further, it is required that the movable core 109' and the card 108' should be fixed by using an adhesive as reinforcement therebetween.

Below, the preferred embodiments of a polarized electromagnetic relay according to the present invention will be explained, with reference to the accompanying drawings.

Figure 8:
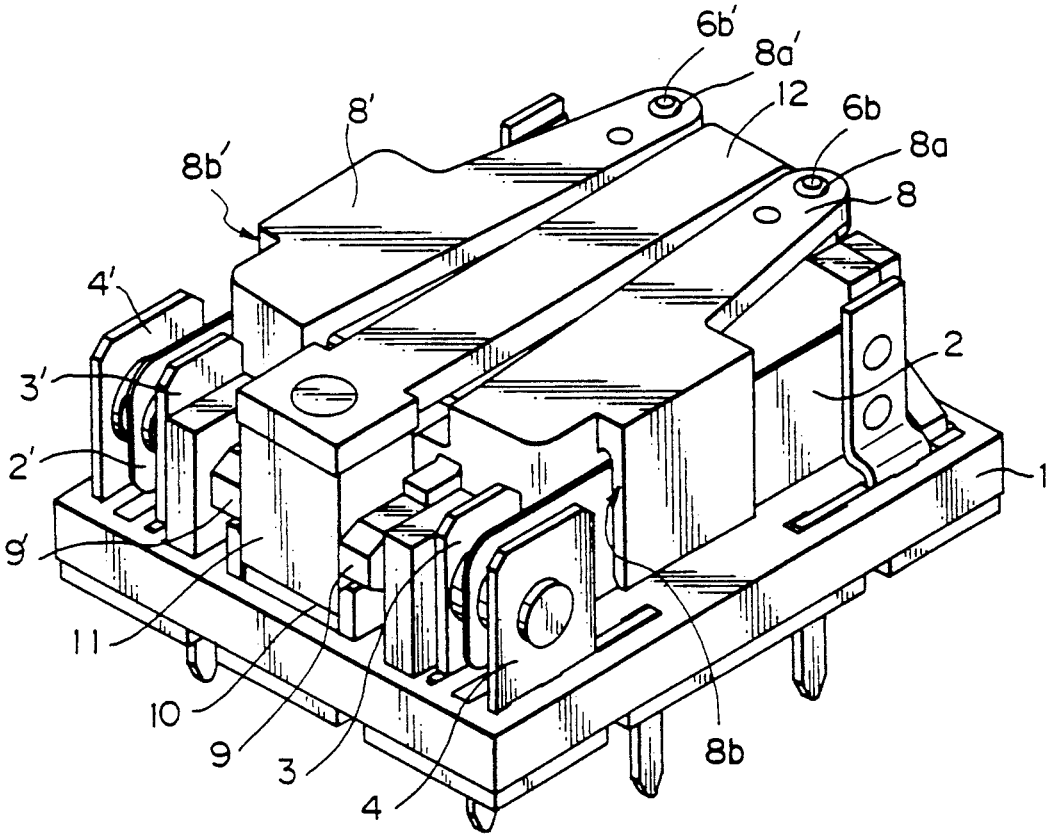
FIG. 8 is an assembled perspective diagram showing a first embodiment of a polarized electromagnetic relay according to the present invention.
Figure 9:
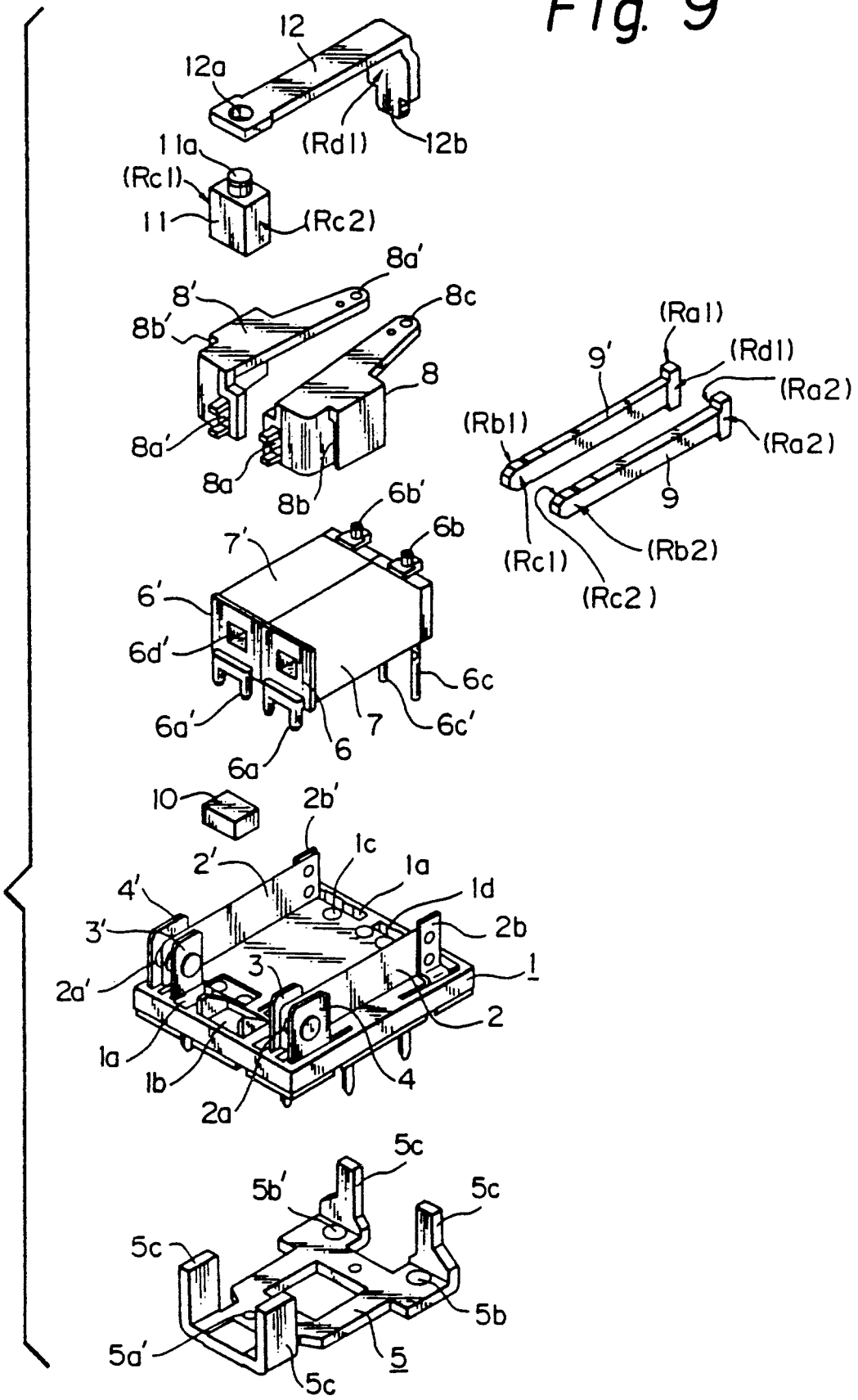
FIG. 9 is an exploded perspective diagram showing the polarized electromagnetic relay shown in FIG. 8.

FIG. 8 shows a first embodiment of a polarized electromagnetic relay according to the present invention, and FIG. 9 is an exploded perspective diagram showing the polarized electromagnetic relay shown in FIG. 8.

In FIGS. 8 and 9, reference numeral 1 denotes a base block, 2, 2' denote movable contact springs, 3, 3' denote break-stationary contact springs, 4, 4' denote make-stationary contact springs, and 5 denotes a first yoke. Further, in FIGS. 8 and 9, reference numerals 6, 6' denote coil elements, 7, 7' denote coils, 8, 8' denote cards, 9, 9' denote movable cores, 10 denotes a permanent magnet, 11 denotes a pole piece and, 12 denotes a second yoke. The movable contact springs 2, 2', brake-stationary contact springs 3, 3', and make-stationary contact springs 4, 4' are directly fixed to the base block 1.

As shown in FIGS. 8 and 9, the first yoke 5 includes four L-shaped top portions 5*c*, and these top portions 5*c* are inserted into four holes 1*a* provided with the base block 1 from the bottom thereof. Note, one permanent magnet 10 is inserted through a through hole 1*b* and is positioned on the surface of the first yoke 5. The coil elements 6, 6' include protrusion portions 6*a*, 6*a'* at the bottom of one flange portion of the coil elements 6, 6' and coil terminals 6*c*, 6*c'* at the bottom of another flange portion thereof, and further the coil elements 6, 6' also include protrusion portions 6*b*, 6*b'* at the top of another flange portion thereof. The protrusion portions 6*a*, 6*a'* are inserted into the first yoke 5 through the base block 1, and the top of each protrusion portion 6*a*, 6*a'* protruding from the bottom of the first yoke 5 is caulked. The coil terminals 6*c*, 6*c'* are inserted into holes 5*b*, 5*b'* of the first yoke 5 through holes 1*c* of the base block 1. Therefore, the coil elements 6, 6' and the first yoke 5 are mounted on the base block 1. Further, the protrusion portions 6*b*, 6*b'* are inserted into through holes 8*c*, 8*c'* provided at one end of cards 8, 8', so that the movable contact springs 2, 2' are simultaneously fitted into U-shaped grooves 8*b*, 8*b'* of the cards 8, 8'.

As shown in FIGS. 8 and 9, the movable cores 9, 9' are inserted into central cavities 6*d*, 6*d'* of the coil elements 6, 6' and holes 8*a*, 8*a'* of the cards 8, 8' from the side of the coil terminal 6*c*. Further, a protrusion portion 11*a* of the pole piece 11 is inserted into a hole 12*a* of the second yoke 12, and the second Yoke 12 has a L-shaped configuration. A top portion 12*b* of the L-shaped configuration of the second yoke 12 is pressed into a hole 1*d* of the base block 1, and the pole piece 11 is mounted on the permanent magnet 10. Note, adhesive is infused from the bottom of the base block 1, the coil terminals and the holes for respective spring terminals are sealed, and the coil terminals and spring terminals are fixed on the base block 1, so that the polarized electromagnetic relay of the present invention shown in FIG. 8 is assembled.

Figure 10:
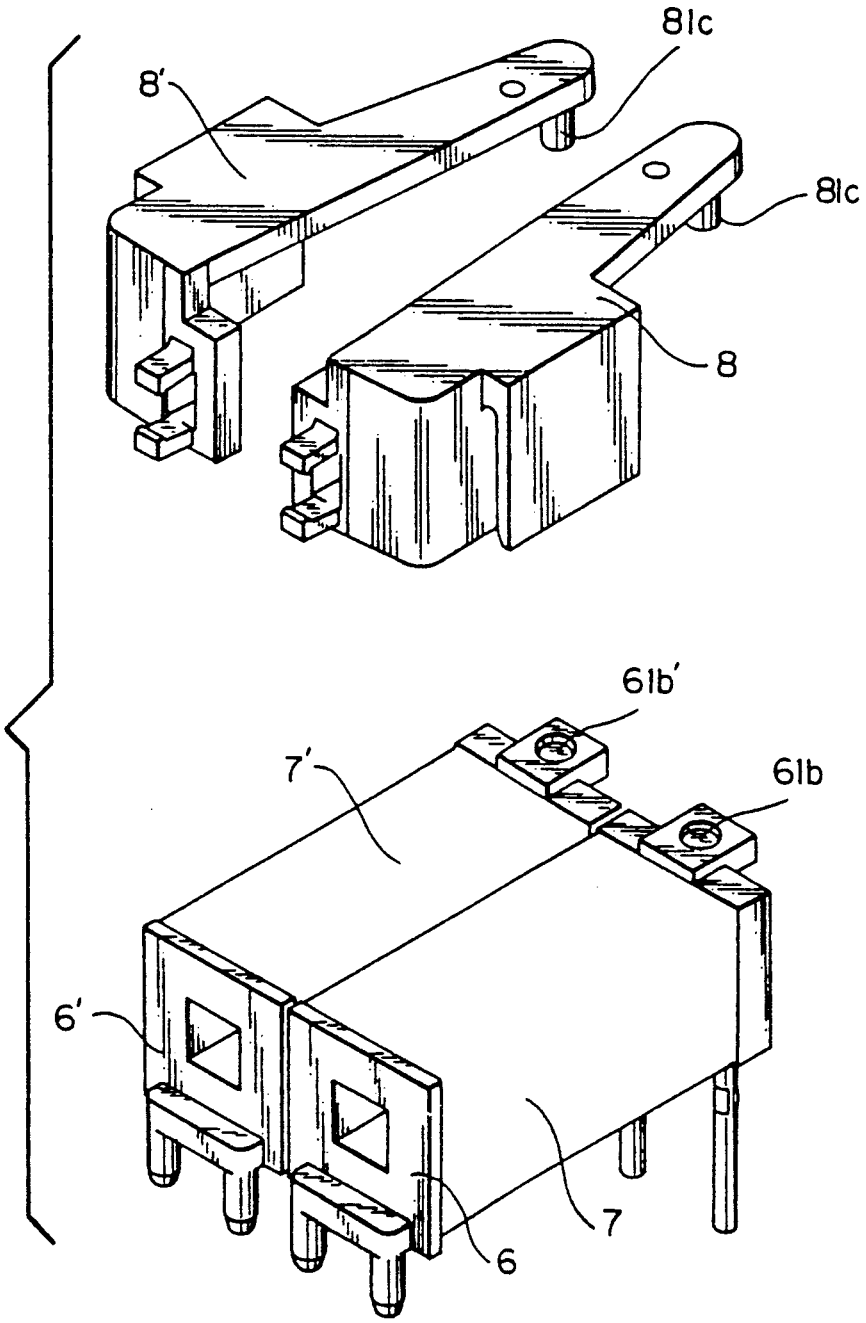
FIG. 10 is an exploded perspective diagram showing modified cards and coil elements of the polarized electromagnetic relay shown in FIG. 8.

FIG. 10 shows modified cards and coil elements of the polarized electromagnetic relay shown in FIG. 8.

As shown in FIG. 10, the two protrusion portions 6*b*, 6*b'* provided on the flanges of the coil elements 6, 6' shown in FIGS. 8 and 9 can be formed as holes 61*b*, 61*b'*. In this case, the holes 8*c*, 8*c'* of the cards 8, 8' shown in FIGS. 8 and 9 are formed as protrusion portions 81*c*, 81*c'* provided in the cards 8, 8' Namely, the holes 8*a*, 8*a'* are provided at one end of the cards 8, 8', and the protrusion portions are provided at the flange of the coil elements 6, 6'. Nevertheless, as shown in FIG. 10, holes 61*b*, 61*b'* can be provided in the flange of the coil elements 6, 6', and protrusion portions 81*c*, 81*c'* can be provided on one end of the cards 8, 8'.

As described above, the polarized electromagnetic relay of this embodiment comprises two groups of electromagnetic relay portions. One electromagnetic relay portion comprises a movable contact spring 2, break-stationary contact spring 3, make-stationary contact spring 4, coil element 6, coil 7, card 8, and movable core 9; and another electromagnetic relay portion comprises a movable contact spring 2', break-stationary contact spring 3', make-stationary contact spring 4', coil element 6', coil 7', card 8', and movable core 9'. Note, a base block, first yoke 5, permanent magnet 10, pole piece 11, and second yoke 12 are commonly provided for both electromagnetic relay portions, or a part of a magnetic circuit is commonly used for two electromagnetic relay portions.

As described above, according to the present embodiment, a small size and economical polarized electromagnetic relay having two groups of electromagnetic relays can be provided.

Next, operation of the polarized electromagnetic relay of the present invention will be explained.

Figure 11A:
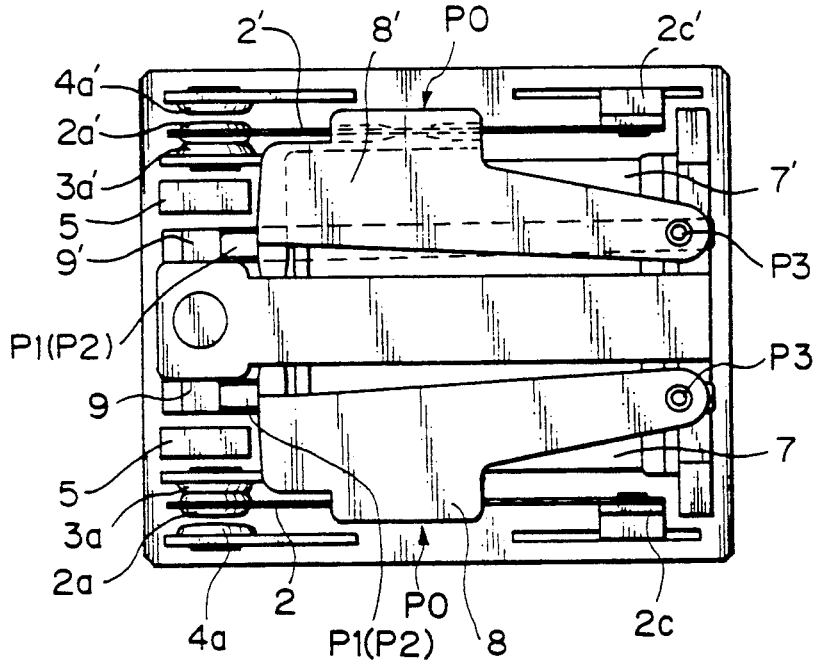
FIGS. 11A and 11B are diagrams for explaining operational states of the polarized electromagnetic relay shown in FIG. 8.
Figure 11B:
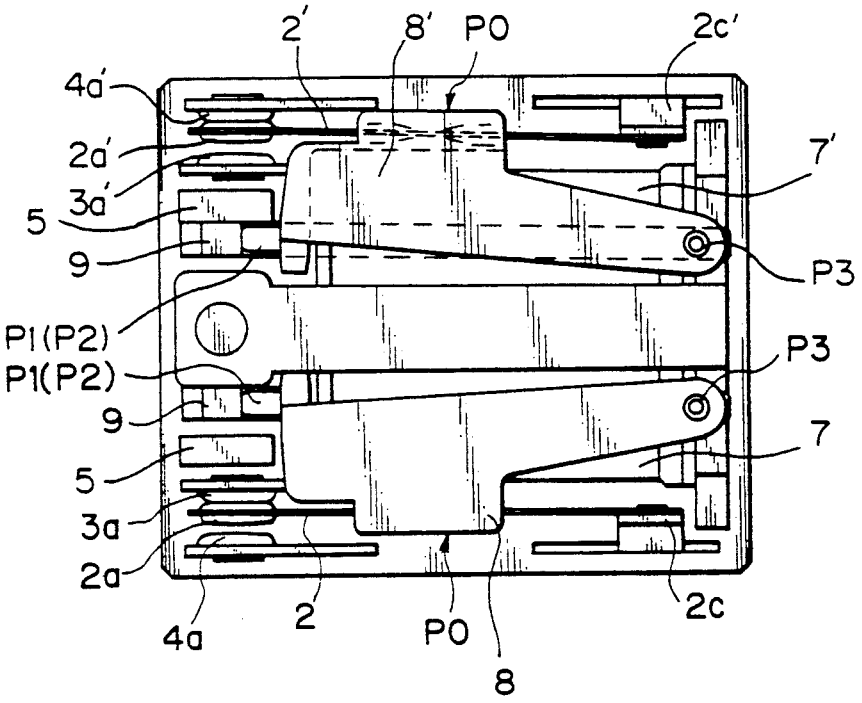
Figure 12A:
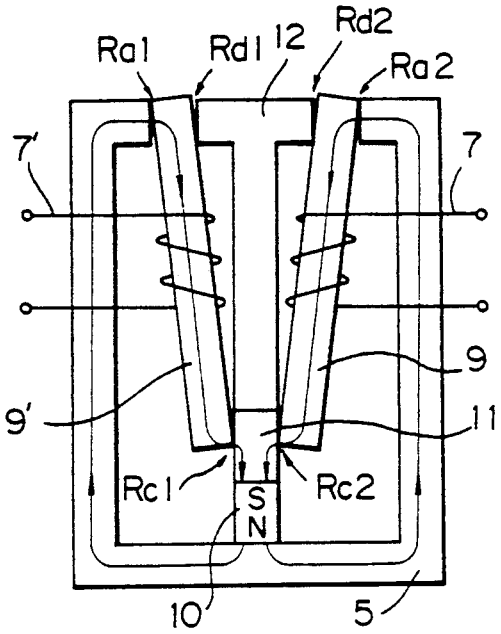
FIGS. 12A, 12B, 12C and 12D are diagrams for explaining operational states of coil elements and movable cores of the polarized electromagnetic relay shown in FIG. 8.
Figure 12B:
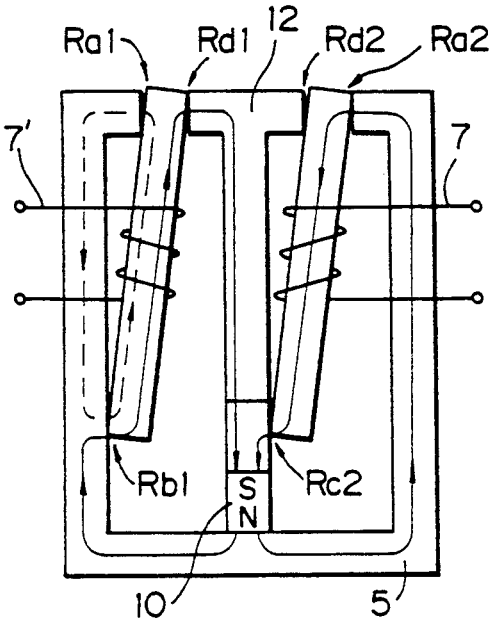
Figure 12C:
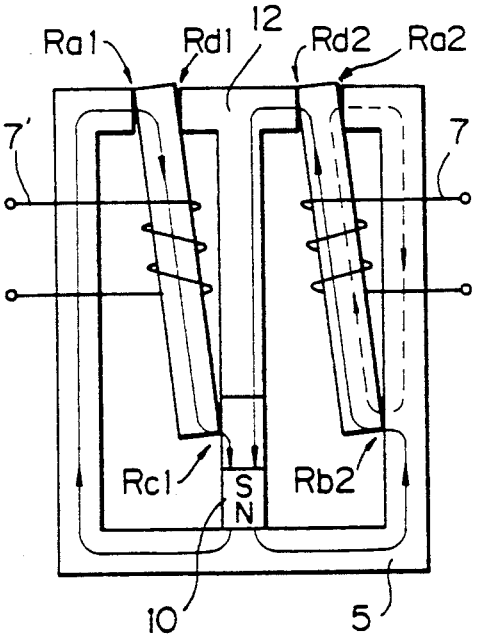
Figure 12D:
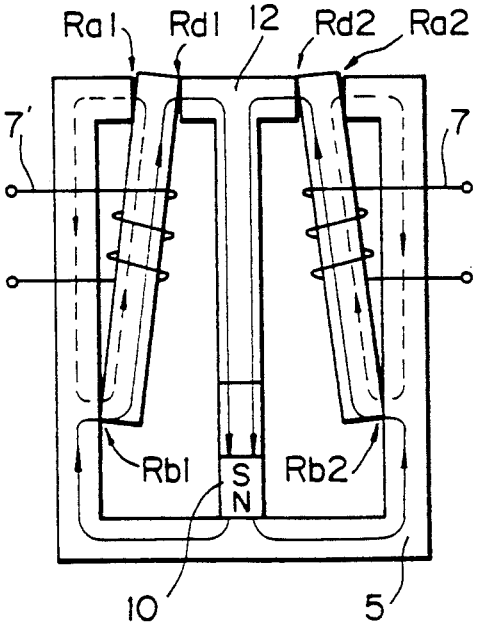

FIGS. 11A and 11B show operational states of the polarized electromagnetic relay shown in FIG. 8. Further, FIGS. 12A, 12B, 12C and 12D also show operational states of coil elements and movable cores of the polarized electromagnetic relay shown in FIG. 8. FIGS. 11A and 12A show the state when both coils 7, 7' are not magnetized, FIGS. 11B and 12B show the state when one coil 7' is magnetized while the other coil 7 is not magnetized, FIG. 12C shows the state when one coil 7 is magnetized while the other coil 7' is not magnetized, and FIG. 12D shows the state when both coils 7, 7' are magnetized. In FIGS. 12A to 12D, references Rb1 and Rb2 denote magnetic reluctances between one end of the movable cores 9', 9 and the first yoke 5, Rc1 and Rc2 denote magnetic reluctances between one end of the movable cores 9', 9 and the pole piece 11, Ra1 and Ra2 denote magnetic reluctances between the other ends of the movable cores 9', 9 and the first yoke 5, and Rd1 and Rd2 denote magnetic reluctances between the other ends Of the movable cores 9', 9 and the second yoke 12, respectively. Note, values of the magnetic reluctance Ra1, Ra2 are almost equal to those of the magnetic reluctances Rd1, Rd2.

First, as shown in FIGS. 11A and 12A, when both coils 7, 7' are not magnetized, the movable cores 9, 9' are attracted to the pole piece 11, movable contacts 2*a*, 2*a'* of the movable contact springs 2, 2' are made to contact break-stationary contacts 3*a*, 3*a'* by the cards 8, 8', and thereby each electromagnetic relay portion is maintained in a break state. In this state, a magnetic circuit caused by the permanent magnet 10, which is illustrated by a solid line, is constituted, and a magnet flux caused by the permanent magnet 10 similarly flows through the movable cores 9, 9'.

Next, as shown in FIGS. 11B and 12B, when the coil 7' is magnetized and the coil 7 is not magnetized, a magnetic flux between the movable core 9' and the pole piece 11 caused by the permanent magnet 10 is negated by flowing the magnetic flux through the coil 7', that is, the top portion (one end) of the movable core 9' is changed to the same polarity as that of the pole piece 11 and is repelled, so that the movable core 9' is attracted to the first yoke 5. One end of the movable core 9' is turned by the magnetization of the coil 7', pivoting on the other end thereof as a supporting point, and the movable core 9' is attracted to the yoke 5. Further, the movable core 9' works together with the card 8', the movable contact 2*a'* is made to contact the make-stationary contact 4*a'* by the movable contact spring 2', and thereby one electromagnetic relay portion including the movable contact spring 2' is changed to a make state while the other electromagnetic relay portion including the movable contact spring 2 is maintained in a break state. Further, when the coil 7' is changed to be not magnetized, the state of FIGS. 11B and 12B returns to the state of FIGS. 11A and 12A.

Note, as shown in FIG. 12B, after attracting the movable core 9' to the first yoke 5, the magnetic flux (which is shown by a solid line in FIG. 12B) caused by the permanent magnet 10 and the magnetic flux (which is shown by a dot line in FIG. 12B) caused by the magnetized coil 7' flow in the movable core 9' in the same direction, and thus the magnetic flux of the magnetized coil 7' can be small. Namely, electrical power flowing in the magnetized coil 7' can be small, or an area occupied by the coil 7' can be small.

Next, as shown in FIG. 12C, when the coil 7 is magnetized and the coil 7' is not magnetized, a magnetic flux between the movable core 9 and the pole piece 11 caused by the permanent magnet 10 is negated by the magnetic flux flowing through the coil 7, and the movable core 9 is attracted to the first yoke 5, so that the electromagnetic relay portion including the movable contact spring 2 is changed to a make state, and the electromagnetic relay portion including the movable contact spring 2' is maintained in a break state. Further, when the coil 7 is changed to be not magnetized, the state shown in FIG. 12C returns to the state of FIGS. 11A and 12A.

Note, this state shown in FIG. 12C is the opposite state of that shown in FIGS. 11B and 12B. Namely, as shown in FIG. 12C, after attracting the movable core 9 to the first yoke 5, the magnetic flux (which is shown by a solid line in FIG. 12C) caused by the permanent magnet 10 and the magnetic flux (which is shown by a dot line in FIG. 12C) caused by the magnetized coil 7 flow in the movable core 9 in the same direction, and thus electrical power flowing in the magnetized coil 7 can be small, or an area occupied by the coil 7 can be small.

Further, as shown in FIG. 12D, when both coils 7, 7' are magnetized, a magnetic flux between the movable core 9' and the pole piece 11 caused by the permanent magnet 10 is negated by the magnetic flux flowing through the coil 7', and further a magnetic flux between the movable core 9 and the pole piece 11 caused by the permanent magnet 10 is negated by the magnetic flux flowing through the coil 7. Therefore, the movable core 9' is attracted to the first yoke 5, and the movable core 9 is also attracted to the first yoke 5, so that both electromagnetic relay portions are changed to make states. Further, when the coils 107, 107' are changed to be not magnetized, the state shown in FIG. 12D returns to the state of FIGS. 11A and 12A.

Note, when applying the polarized electromagnetic relay of the present embodiment to control a motor, the state when both coils 7, 7' are not magnetized shown in FIGS. 11A and 12A corresponds to the case shown in FIG. 5A, and the state when only one coil 7' is magnetized shown in FIGS. 11B and 12B corresponds to the case shown in FIG. 5B. Further, the state when only one coil 7 is magnetized shown in FIG. 12C corresponds to the case shown in FIG. 5C, and the state when both coils 7, 7' are magnetized shown in FIG. 12D corresponds to the case shown in FIG. 5D. The operation of the motor is the same as that where the polarized electromagnetic relay of the related art is applied to the motor, as previously explained, so an explanation thereof is omitted.

Figure 13:
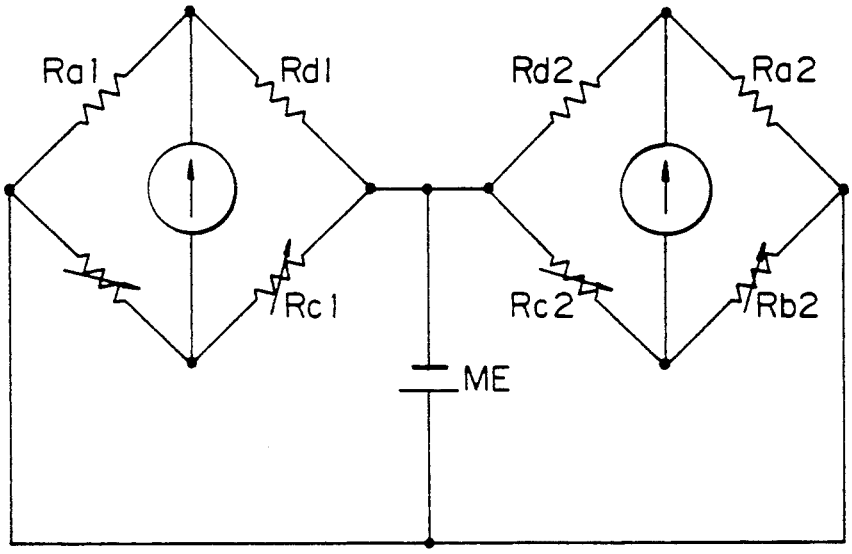
FIG. 13 is a diagram showing an equivalent magnetic circuit of the polarized electromagnetic relay shown in FIG. 8.

FIG. 13 shows the equivalent magnetic circuit of the polarized electromagnetic relay shown in FIG. 8. In FIG. 13, references Rb1 and Rb2 denote magnetic reluctances between the first yoke 5 and one end of the movable cores 9', 9, Rc1 and Rc2 denote magnetic reluctances between the pole piece 11 and one end of the movable cores 9', 9, Ra1 and Ra2 denote magnetic reluctances between the first yoke 5 and the other ends of the movable cores 9', 9, and Rd1 and Rd2 denote magnetic reluctances between the second yoke 12 and the other ends of the movable cores 9', 9, respectively. Note, the magnetic reluctances Ra1, Ra2 and the magnetic reluctances Rd1, Rd2 are formed to be almost equal (Ra1 ≈Ra2≈Rd1≈Rd2).

Further, magnetic reluctances Rc1-off, Rc2-off between the movable cores 9', 9 and the pole piece 11 during a non-operating state and magnetic reluctances Rb1-on, Rb2-on between the movable cores 9', 9 and the first yoke 5 during an operating state are formed to be almost equal, and magnetic reluctances Rb1-off, Rb2-off between the movable cores 9', 9 and the first yoke 5 during the non-operating state and magnetic reluctances Rc1-on, Rc2-on between the movable cores 9', 9 and the pole piece 11 during the operating state are formed to be almost equal. Namely, the following relationships are satisfied.

(Rc1-off≈Rc2-off≈Rb1-on≈Rb2-on)

(Rb1-off≈Rb2-off≈Rc1-on≈Rc2-on)

As explained above in detail, according to the present embodiment, since magnetic reluctances of two electromagnetic relay portions from a permanent magnetic are made to be equal, and when operating states of one of the two electromagnetic relay portions are changed, a magnetic circuit of another coil element is not influenced thereby. Namely, in any states shown in FIGS. 12A to 12D, one magnetic circuit does not influence to the other magnetic circuit, and thus the operating voltage does not change. Further, in any case that combines the magnetized or not magnetized states of the two coil elements, a magnetic flux caused by the permanent magnet 10 is almost equal in both coil elements 6, 6' (coils 7, 7'), and thus the operating voltage is stable.

Figure 14:
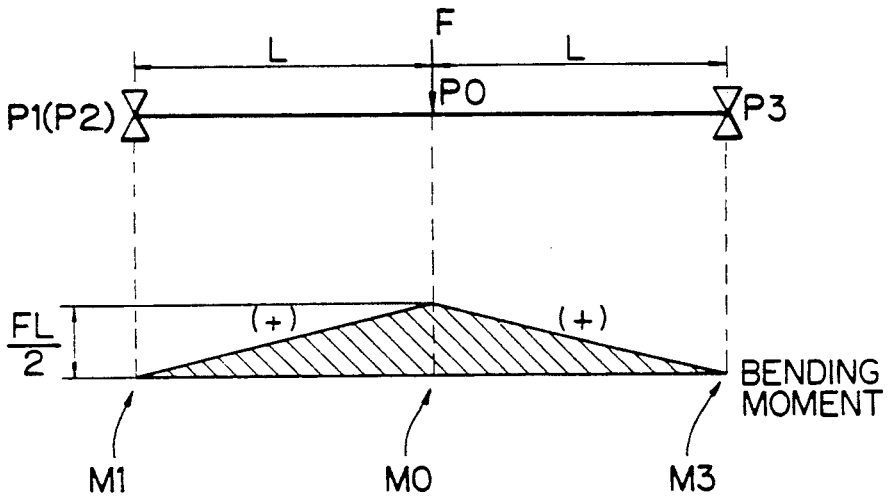
FIG. 14 is a diagram for explaining moments applied to a movable contact spring of the polarized electromagnetic relay shown in FIG. 8.

FIG. 14 shows moments applied to a movable contact spring of the polarized electromagnetic relay shown in FIG. 8. In FIG. 14, reference P1 (P2) denotes a fixed point between the card 8' (8) and the movable core 9' (9), and P3 denotes a supporting point of the card 8' (8) supported around the center position of the rotation of the movable core 9' (9), and P0 denotes a force applying point of the card 8' (8). When applying a force F caused by the movable contact spring 2' to the card 8' having a length (L×2) between the points P1 and P3 at the point P0 perpendicular to the line P1–P3 of the card 8', a bending moment M0 at the point P0 is determined as M0=PL/2, and bending moments Ml and M3 at the fixed point P1 and d supporting point P3 are determined as M1=M3=0.

As described above, in a card construction of the present embodiment in comparison to the related art card construction, a supporting point P3 of a card 8' is provided at the center position of the rotation of a movable core 9' (9), and a bending moment M3 at the supporting point P3 and a bending moment M1 at the fixed point P1 caused by a movable contact spring 2' are made to be zero by supporting two points P1 and P3 of the card 8'. Therefore, even through repeated operations of a polarized electromagnetic relay, a joint portion (P1, P2) between the card 8' (8) and the movable core 9' (9) is not weakened, and the operation of the polarized electromagnetic relay can be stable. Further, an adhesive is not required to increase the strengthen between the card and the movable core, and thus assembling processes can be simplified and an economical electromagnetic relay can be provided.

Figure 15:
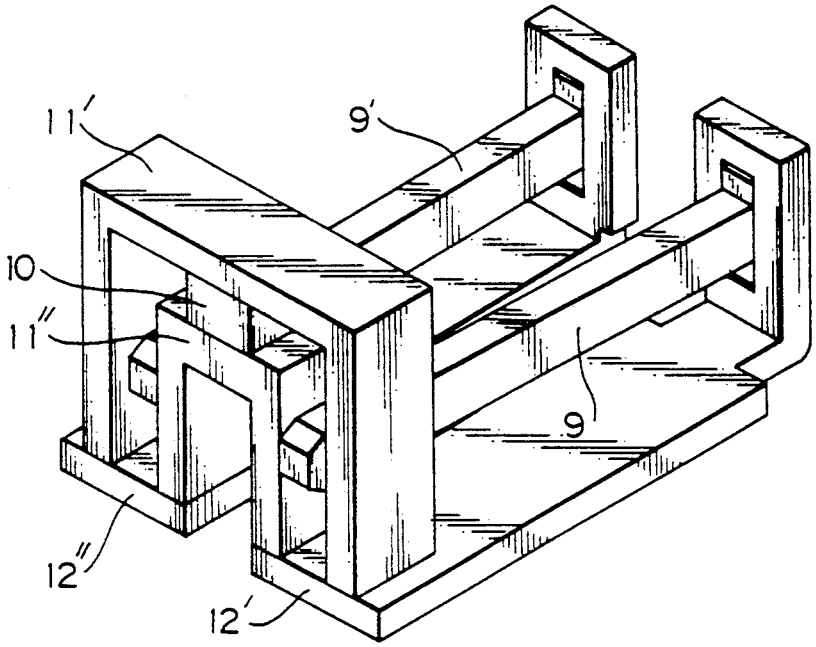
FIG. 15 is a perspective diagram showing main parts of a second embodiment of a polarized electromagnetic relay according to the present invention.

FIG. 15 shows main parts of a second embodiment of a polarized electromagnetic relay according to the present invention.

As shown in FIG. 15, in this second embodiment of the polarized electromagnetic relay, two pole piece elements 11', 11" and two yokes 12', 12" having the same shapes are provided instead of the pole piece 11, first yoke 5 and second yoke 12 shown in FIGS. 8 and 9. Note, one pole piece element 11' is formed larger than the other pole piece element 11", both pole piece elements 11' and 11" are mounted on the two yokes 12' and 12", and a permanent magnet 10 is provided between the pole piece elements 11' and 11". Further, the other configurations of this second embodiment are the same as the first embodiment with reference to FIGS. 8 to 14. Namely, the configurations of the movable contact spring 2 (2'), break-stationary contact spring 3 (3'), make-stationary contact spring 4 (4'), coil element 6 (6'), coil 7 (7'), card 8 (8'), and movable core 9 (9') are the same those of the first embodiment shown in FIGS. 8 and 9.

Figure 16:
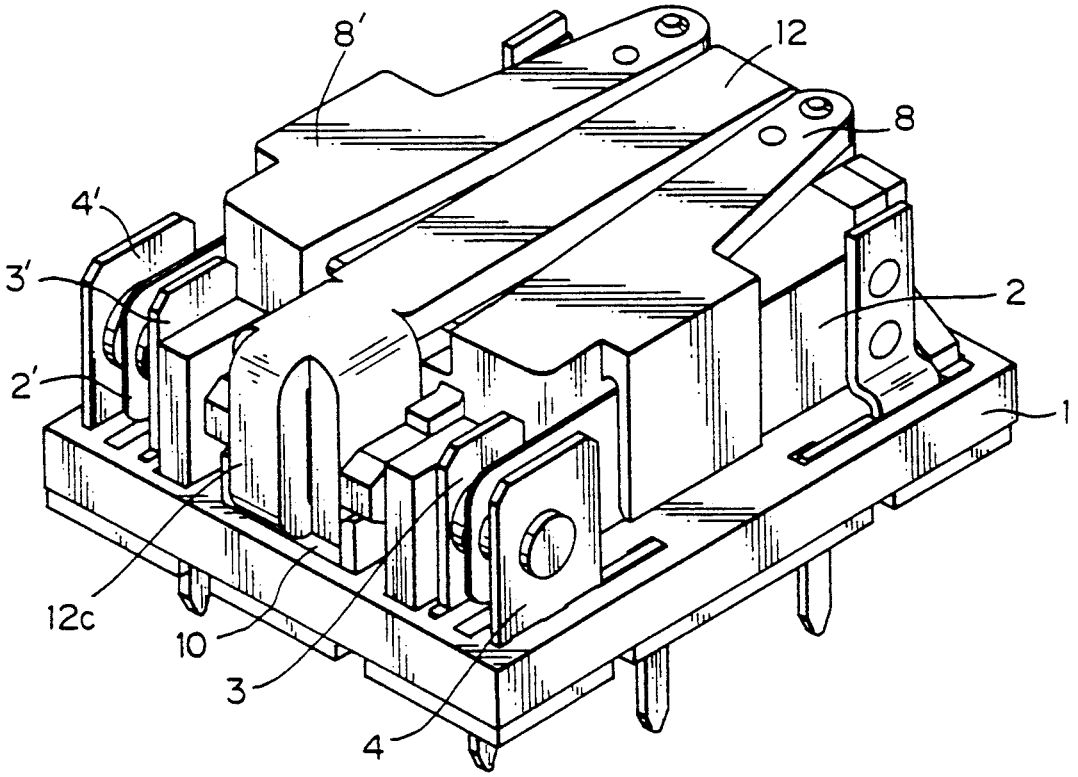
FIG. 16 is a perspective diagram showing a third embodiment of a polarized electromagnetic relay according to the present invention.
Figure 17:
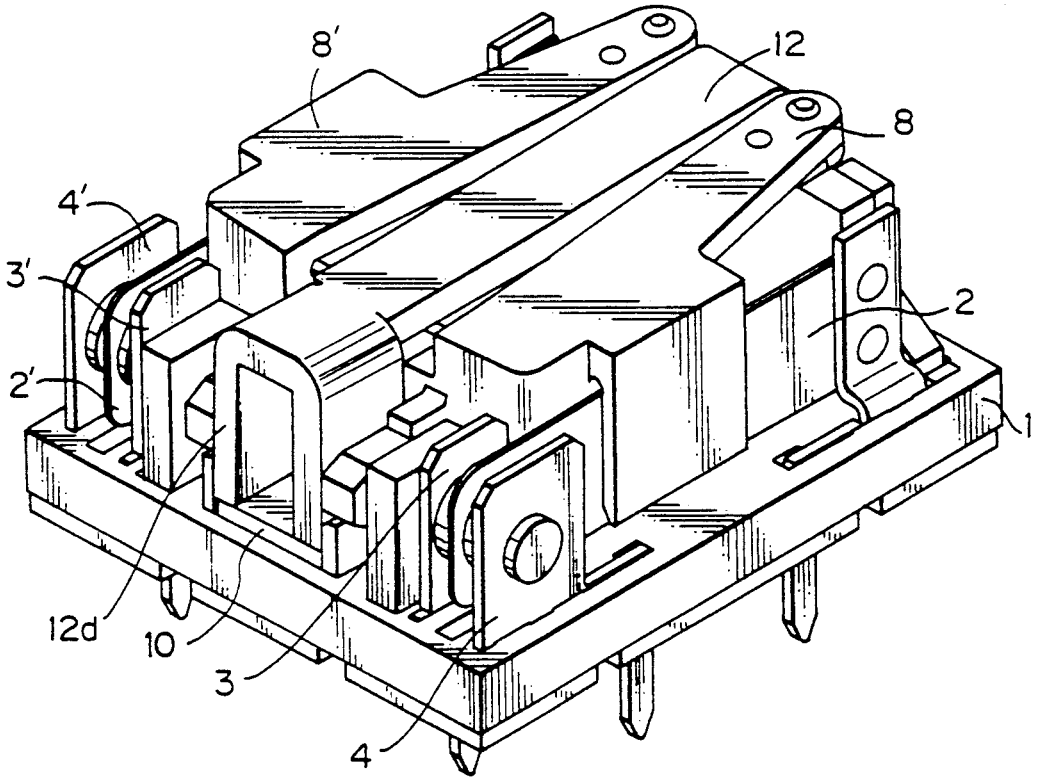
FIG. 17 is a perspective diagram showing a fourth embodiment of a polarized electromagnetic relay according to the present invention.

FIG. 16 shows a third embodiment of a polarized electromagnetic relay according to the present invention, and FIG. 17 shows a fourth embodiment of a polarized electromagnetic relay according to the present invention.

As shown in FIG. 16, in the third embodiment, the top portion 12*c* of the second yoke 12 is formed as an E-shaped configuration and is bent toward the base block 1, or the permanent magnet 10. In this third embodiment, the pole piece 11 shown in FIGS. 8 and 9 is formed as the top portion 12*c* of the second yoke 12, and thus the pole piece 11 can be deleted. Therefore, the number of parts for assembling the polarized electromagnetic relay can be decreased, and the required assembling time and the required cost can be reduced.

As shown in FIG. 17, in the fourth embodiment, the top portion 12*d* of the second yoke 12 is formed as a T-shaped configuration and is bent toward the base block 1, or the permanent magnet 10. In this fourth embodiment, the pole piece 11 shown in FIGS. 8 and 9 is formed as the top portion 12*d* of the second yoke 12, and thus the pole piece 11 can be deleted. Therefore, the number of parts for assembling the polarized electromagnetic relay can be decreased, and the required assembling time and the required cost can be reduced. By comparing this fourth embodiment with the third embodiment shown in FIG. 16, a magnet flux of the permanent magnet 10 flowing through the second yoke 12 of the fourth embodiment may be decreased even more than that of the third embodiment. Nevertheless, the bending process of the top portion 12*d* of the second yoke 12 of the fourth embodiment can be more easily carried out than that of the third embodiment. Note, in the embodiments shown in FIGS. 16 and 17, the other parts and configurations except for the top portion of the second yoke 12 are the same as those shown in FIGS. 8 and 9.

As described above, according to the present invention, a small size and economical polarized electromagnetic relays having two groups of electromagnetic relay can be provided. In the present invention, a stable operation regardless the states of magnetization or non-magnetization of one or both coils of the two electromagnetic relay portions can be realized, and further, a stable operation and a durability of the two electromagnetic relay portions can be realized by improving card constructions to a two-support points configuration, by decreasing a bending moment caused by the movable contact spring, and by strengthening a joint portion between the card and the movable core. Further, according to the present invention, a small and economical electromagnetic relay avoiding the use of an adhesive for the fixed point between the card and the movable core can be provided.

Many different embodiments of the present invention may be constructed without departing from the spirit and scope of the present invention, and it should be understood that the present invention is not limited to the specific embodiments described in this specification, except as defined in the appended claims.

We claim:

1. A polarized electromagnetic relay comprising:
a base block;
a first yoke mounted on said base block;
a second yoke mounted on said base block to form magnetic circuits with said first yoke;
a permanent magnet provided between said first yoke and said second yoke;
two coil elements including two coils;
two movable cores being independently operated by the magnetization of each of said coils;
two cards each fixed to the top portion of each of said two movable cores;
two movable contact springs having movable contacts being operated by working together with said cards; and
stationary contact springs provided opposite each other on said base block, and each of said movable contact springs being positioned between said stationary contact springs, wherein said first yoke and said second yoke are used to flow a magnetic flux caused by said permanent magnet in said movable core in the same direction as a magnetic flux caused by the magnetization of said coil.

2. A polarized electromagnetic relay as claimed in claim 1, wherein said second yoke is in contact with said permanent magnet through a pole piece.

3. A polarized electromagnetic relay as claimed in claim 2, wherein said second yoke and said pole piece are uniformly formed.

4. A polarized electromagnetic relay as claimed in claim 3, wherein the top portion of said second yoke is formed as an E-shape configuration to be bent to constitute said pole piece.

5. A polarized electromagnetic relay as claimed in claim 3, wherein the top portion of said second yoke is formed as a T-shape configuration to be bent to constitute said pole piece.

6. A polarized electromagnetic relay as claimed in claim 1, wherein said card includes a hole at one end of said card, said coil element includes a protrusion portion at one flange of said coil element, and said protrusion portion of said coil element is inserted into said hole of said card.

7. A polarized electromagnetic relay as claimed in claim 1, wherein said card includes a protrusion portion at one end of said card, said coil element includes a hole at one flange of said coil element, and said protrusion portion of said card is inserted into said hole of said coil element.

8. A polarized electromagnetic relay as claimed in claim 1, wherein one end of said card is supported at a supporting point by said coil element, and said movable core is fixed at a fixed point by said card.

9. A polarized electromagnetic relay as claimed in claim 8, wherein said card is rounded about said supporting point.

10. A polarized electromagnetic relay as claimed in claim 1, wherein said card comprises a U-shape groove at approximately the center of said card, and said movable contact spring is fitted into said groove of said card.

11. A polarized electromagnetic relay as claimed in claim 1, wherein said polarized electromagnetic relay is applied to control the direction of rotation of a motor or the direction of movement of a solenoid.

12. A polarized electromagnetic relay comprising:
a base block;
first and second yoke elements having the same shapes and mounted on said base block;
first and second pole piece elements to form magnetic circuits with said first and second yoke elements;
a permanent magnet provided between said first pole piece element and said second pole piece element;
two coil elements including two coils;
two movable cores being independently operated by the magnetization of each of said coils;
two cards each fixed to the top portion of each of said two movable cores;
two movable contact springs having movable contacts being operated by working together with said cards; and
stationary contact springs provided opposite each other on said base block, and each of said movable contact springs being positioned between said stationary contact springs, wherein said first and second yoke elements and said first and second pole piece elements are used to flow a magnetic flux caused by said permanent magnet in said movable core in the same direction as a magnetic flux caused by the magnetization of said coil.

13. A polarized electromagnetic relay as claimed in claim 12, wherein said card includes a hole at one end of said card, said coil element includes a protrusion portion at one flange of said coil element, and said protrusion portion of said coil element is inserted into said hole of said card.

14. A polarized electromagnetic relay as claimed in claim 12, wherein said card includes a protrusion portion at one end of said card, said coil element includes a hole at one flange of said coil element, and said protrusion portion of said card is inserted into said hole of said coil element.

15. A polarized electromagnetic relay as claimed in claim 12, wherein one end of said card is supported at a supporting point by said coil element, and said movable core is fixed at a fixed point by said card.

16. A polarized electromagnetic relay as claimed in claim 15, wherein said card is rounded about said supporting point.

17. A polarized electromagnetic relay as claimed in claim 12, wherein said card comprises a U-shape groove at approximately the center of said card, and said movable contact spring is fitted into said groove of said card.

18. A polarized electromagnetic relay as claimed in claim 12, wherein said polarized electromagnetic relay is applied to control the direction of rotation of a motor or the direction of movement of a solenoid.

* * * * *